US006879700B2

(12) United States Patent
Matsudo et al.

(10) Patent No.: US 6,879,700 B2
(45) Date of Patent: Apr. 12, 2005

(54) SPEAKER AND ITS PRODUCTION METHOD OF THE SAME

(75) Inventors: Kenichi Matsudo, Tamaho-machi (JP); Tsutomu Saito, Tamaho-machi (JP); Kunihiro Houjo, Tamaho-machi (JP)

(73) Assignee: Minebea Co., Ltd., Nagano-ken (JP)

( * ) Notice: Subject to any disclaimer, the term of this patent is extended or adjusted under 35 U.S.C. 154(b) by 206 days.

(21) Appl. No.: 09/789,762

(22) Filed: Feb. 22, 2001

(65) Prior Publication Data

US 2001/0017930 A1 Aug. 30, 2001

(51) Int. Cl.[7] ..... H04R 25/00

(52) U.S. Cl. ..... 381/412; 381/396; 381/398; 381/433

(58) Field of Search ..... 381/396, 398, 381/403, 412, 420, 433, 404, 405, 432, 419, FOR 159, 416; 29/609.1

(56) References Cited

U.S. PATENT DOCUMENTS 4,565,905 A * 1/1986 Nation
5,111,510 A * 5/1992 Mitobe
2002/0071588 A1 * 6/2002 Proni ..... 381/403

FOREIGN PATENT DOCUMENTS

| | | | | |
|---|---|---|---|---|
| DE | 3150-041 | * | 6/1983 | ..... 381/FOR 159 |
| JP | 55-25288 | | 2/1980 | |
| JP | 5-22793 | * | 1/1993 | ..... 381/FOR 159 |
| JP | 5-252591 | * | 9/1993 | |

* cited by examiner

*Primary Examiner*—Suhan Ni
(74) *Attorney, Agent, or Firm*—McDermott Will & Emery LLP

(57) ABSTRACT

A speaker and its production method in which productivity can be enhanced and characteristics can be easily improved. A frame 14 of a speaker 10 is divided into a first frame body 15 and a second frame body 44 and the first and second frame bodies 15, 44 can be put together by engaging. A voice coil 35, a magnetic circuit 16 and a damper 17 are attached to the first frame body 15 constituting a first assembly 11. A cone paper 45 is attached to the second frame body 44 constituting a second assembly 12. Claw-shaped hooks formed on the second frame body 44 are to catch an engaging part 21 formed at the first frame body 15 in order to connect the first assembly 11 and the second assembly 12 to construct the speaker 10. The two assemblies 11, 12 can be produced in parallel. This leads to an improvement in the production efficiency.

6 Claims, 4 Drawing Sheets

SPEAKER AND ITS PRODUCTION METHOD OF THE SAME

BACKGROUND OF THE INVENTION

The present invention relates to a speaker used for various types of audio apparatuses, especially to a speaker having a diaphragm and a damper fixed to a frame, and to a production method of the same.

What is called "Put-in method" where component parts are put in one by one has been conventionally employed in a production process of speakers.

A concrete description follows with reference to a speaker 1 shown in FIG. 6. A frame 3 is fixed to a magnetic circuit 2 and a voice coil 4 is set at its center. Then, a damper 6 is put in and connected to a bobbin 4*a* of the voice coil 4 and a bottom part 3*a* of the frame 3. Further, a cone paper 7 as a diaphragm is put in and connected to the bobbin 4*a* of the voice coil 4 and a head part 3*b* of the frame 3. Furthermore, a lead wire 4*b* of the voice coil 4 and a terminal 8 set on the outer surface of the frame 3 are connected via a tinsel wire 9.

The head part 3*b* and the bottom part 3*a* are integrally formed to constitute this frame 3. The diameter Lb of the head part 3*b* is designed to be equal to or larger than the diameter La of the bottom part 3, so that the damper 6 and the cone paper 7 can be put in without difficulty.

Since the conventional speaker structure described above uses a frame structure intended for the Put-in method production process, it is impossible to produce each assembly part in parallel, for example, by pre-connecting a damper and a voice coil, or a cone paper and a frame. This makes it difficult to simplify the production process, thereby prohibiting an improvement in the productivity.

Further, since each assembly part produced separately cannot be applied universally to speakers of other types, a production method where various types of speakers are produced by combining standardized assembly parts can not be employed. This leads to difficulty in improving the productivity.

In addition, characteristics cannot be improved easily because the dimensions of the damper and the cone paper are fixed due to the frame structure where its head and bottom parts are integrally formed.

Furthermore, the wiring work between the voice coil and the terminal is forced to be troublesome due to a limited space resulted from the existence of the head part of the frame and the cone paper. Especially in a frame with a smaller diameter or a smaller depth, the wiring work becomes more difficult due to a further limited space. This may cause problems to happen.

SUMMARY OF THE INVENTION

In view of such a current situation, the present invention seeks to provide a speaker and a production method thereof wherein the productivity can be enhanced and the characteristics can be improved easily.

To achieve the objective, a speaker according to a first aspect of the present invention comprises a frame consisting of a first frame body and a second frame body attached to the first frame body, a voice coil, a magnetic circuit and a damper which are attached to the first frame body, and a diaphragm attached to the second frame body.

In this structure, since the frame is divided into the first frame body and the second frame body, it is possible to separately produce a first assembly wherein the voice coil, the magnetic circuit and the damper are attached to the first frame body, and a second assembly wherein the diaphragm is attached to the second frame body, and then put together the first assembly and the second assembly in order to produce a speaker.

Each part (assembly) can be produced in parallel. Parts can be standardized for various types of speakers. The wiring of the voice coil can be done free from the interference of the diaphragm. The productivity is largely improved compared to the structure where parts are put one by one in the frame integrally formed.

Furthermore, for example, the diameter of the damper can be easily designed to be larger than that of the diaphragm and the compliance is increased, accordingly the minimum resonance frequency can be lowered, whereby speakers capable of reproducing a lower sound can be produced with a higher productivity.

In the speaker according to a second aspect of the present invention, since the first frame body and the second frame body according to the first aspect are attached to each other, by means of engagement, the first frame body and the second frame body can be coupled together easily, thereby improving the productivity.

In the production method of the speaker according to a third aspect of the present invention, a voice coil, a magnetic circuit and a damper are attached to the first frame body, a diaphragm is attached to the second frame body, then the first frame body with the voice coil, the magnetic circuit and the damper and the second frame body with the diaphragm are attached to each other, and the diaphragm attached to the second frame body is attached to the voice coil attached to the first frame body.

In this structure, since the frame is divided into the first frame body and the second frame body, the first assembly in which the voice coil, the magnetic circuit and the damper are attached to the first frame body and the second assembly in which the diaphragm is attached to the second frame body can be separately produced and then combined to produce the speaker.

This enables the parallel production of each assembly, the standardization of the parts for various types of speakers, and the wiring of the voice coil without the interference from the diaphragm. So, the productivity becomes largely improved compared to the structure where parts are put one by one in the integrally formed frame.

This also makes it easier to have the diameter of the damper larger than that of the diaphragm. This leads to an increased compliance, allowing the minimum resonance frequency to be lowered, whereby the speaker capable of reproducing a lower sound can be produced efficiently.

DETAILED DESCRIPTION OF THE INVENTION

One preferred embodiment of the speaker and its production method of the present invention is explained below with reference to attached figures.

Figure 1:
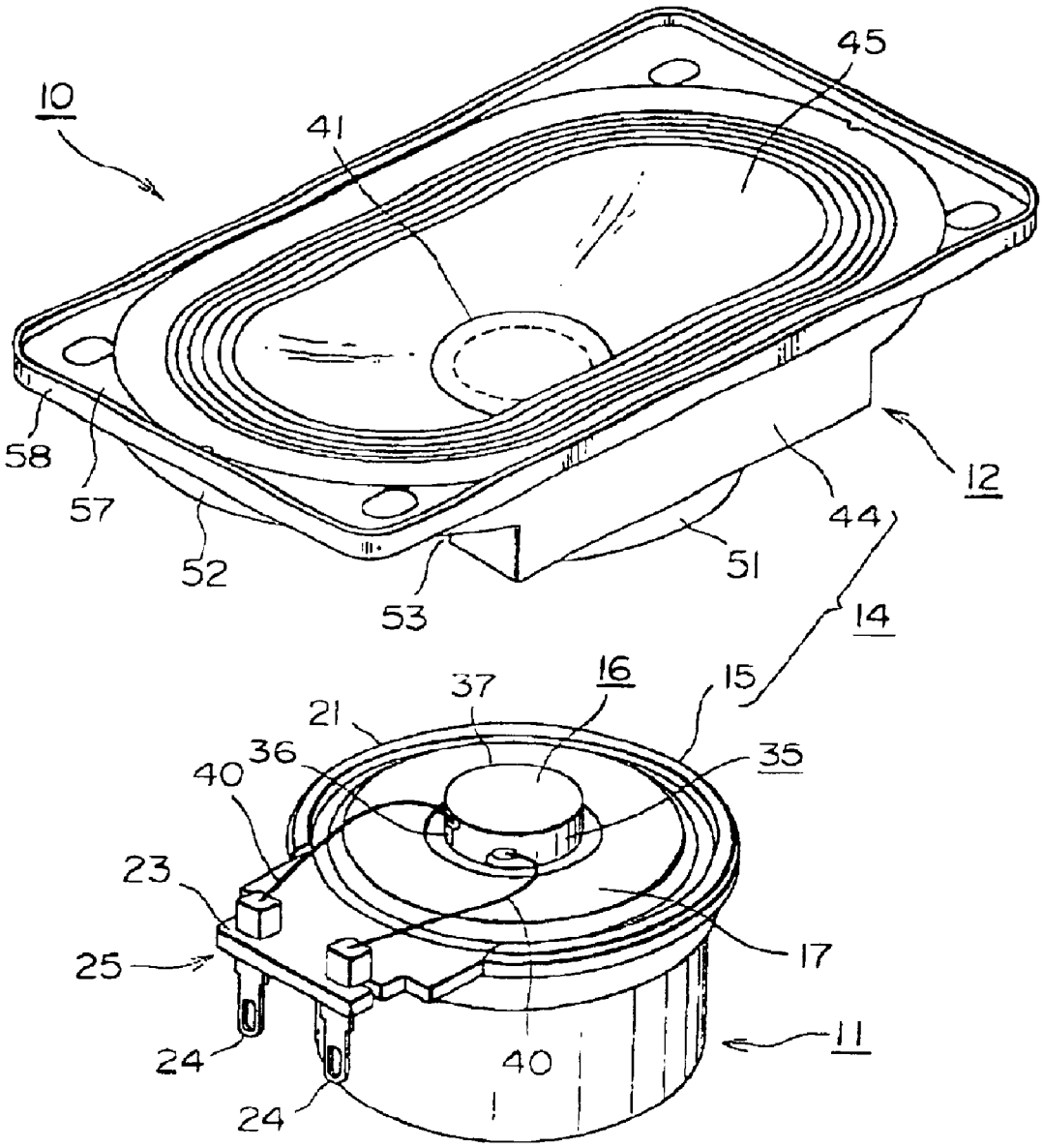
FIG. 1 is an exploded perspective view showing an embodiment of a speaker of the present invention.
Figure 2:
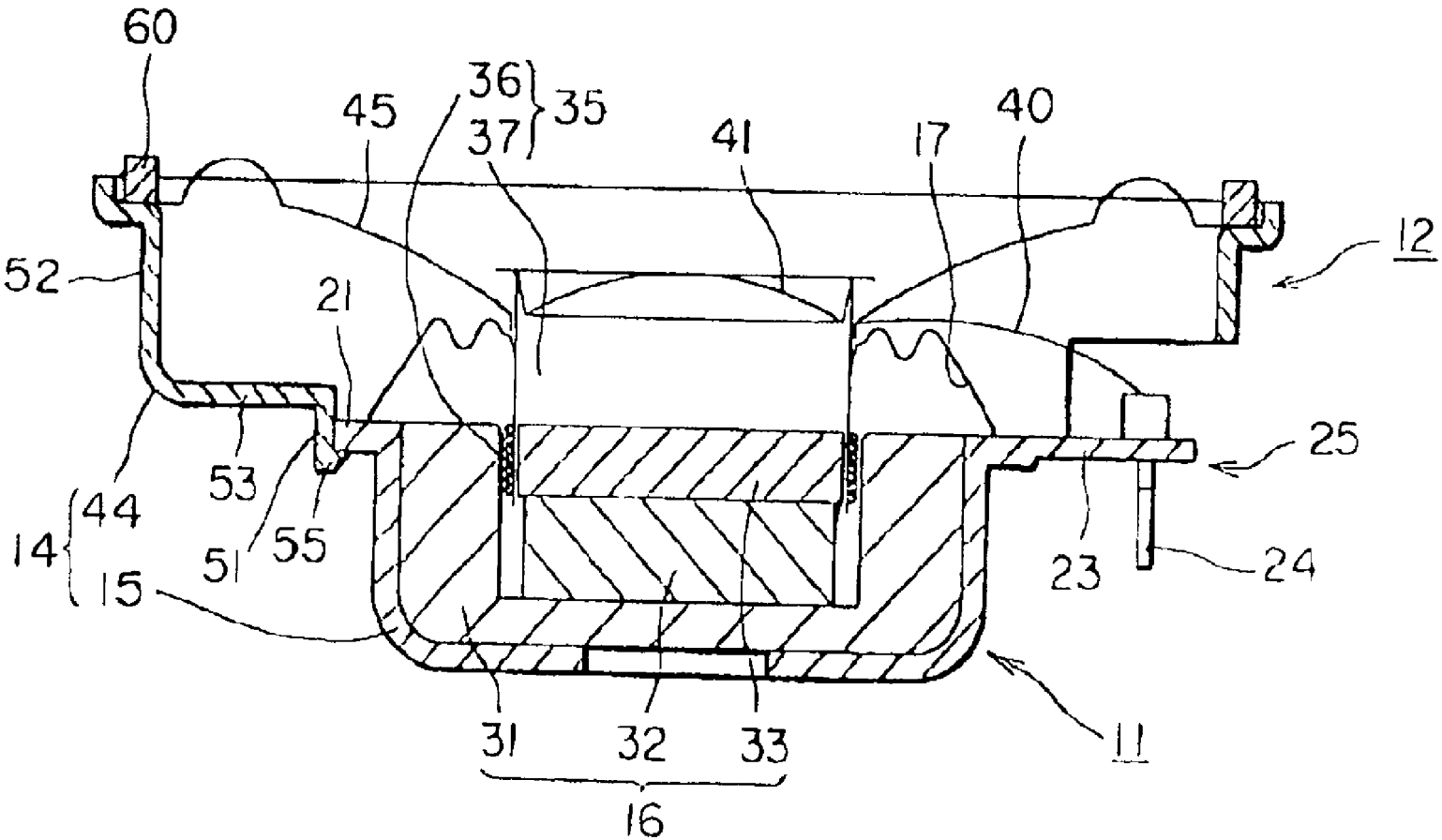
FIG. 2 is a cross-section view of the speaker shown in FIG. 1.

In FIGS. 1 and 2, numeral 10 denotes a speaker. The speaker 10 comprises a first assembly 11 as a first assembled part, and a second assembly 12 as a second assembled part.

The first assembly 11 comprises a first frame body 15 which is the lower part of a frame 14, and a voice coil 35, a magnetic circuit 16 and a damper 17 which are attached to the first frame body 15.

The first frame body 15 is integrally formed with heat-resistant ABS resin in approximately cylindrical shape having a bottom, the inside of which constitutes a magnetic circuit receptacle. At the end of the head part of the first frame body 15, an engaging part 21 is formed protruding outward like a flange.

At a part of the engaging part 21, a terminal base 23 is integrally formed with outward protrusion. A pair of pins 24, 24 are attached to the terminal base 23 thereby forming a terminal 25.

The magnetic circuit 16 comprises a yoke 31 fixed to the magnetic circuit receptacle of the first frame body 15, a magnet 32 fixed to the recessed part at the center of the yoke 31, and a pole 33 fixed to the top of the magnet 32.

The voice coil 35 comprises a cylindrical bobbin 37 around which a winding 36 is wound. The voice coil 35 is held at a desired position by the damper 17 whose inner circumferential part is connected to the bobbin 37 and whose outer circumferential part is connected to the vicinity of the outer circumference of the head part of the first frame body 15.

Both ends of the winding 36 constituting the voice coil 35 are pre-connected to tinsel wires 40, 40. Further, each of the tinsel wires 40, 40 is connected to each of the pins 24, 24 of the terminal 25, respectively.

On the other hand, the second assembly 12 comprises a second frame body 44 which is the upper part of the frame 14, and a cone paper 45 as a diaphragm attached to the second frame body 44.

The second frame body 44 is integrally formed in approximately cylindrical shape with heat-resistant ABS resin, where a bottom part 51 with approximately cylindrical shape and a head part 52 with approximately ellipsoidal shape in plane view are connected via a step part 53.

The bottom part 51 of the second frame body is formed to have an inner diameter such that it fits onto the outer circumferential part of the engaging part 21 of the first frame body 15. At three places on the bottom part 51 of the second frame body, a claw-shaped hook part 55 is integrally formed with elasticity and deformability to engage with the bottom face of the engaging part 21 of the first frame body 15.

At the upper end part of the head part 52 of the second frame body, a front board part 57 with approximately rectangular shape in outward appearance is integrally formed. Further, a rim part 58 protrudes upward at the periphery of the front board part 57.

The outer circumference of the cone paper 45 is fixed to the front board part 57 using a ring-shaped gasket 60, and the inner circumference of the cone paper 45 is connected to the bobbin 37 of the voice coil 35 by a desired means such as adhesion. A center cap 41 is attached to the top of the bobbin 37. The cone paper 45 and the center cap 41 may be integrated.

In the production of the speaker 10, the first assembly 11 and the second assembly 12 are produced in parallel, then the second frame body 44 is engaged with the first frame body 15, and the cone paper 45 is connected to the bobbin 37 of the voice coil 35.

As described above, according to the present embodiment, the frame 14 of the speaker 10 is of two-piece structure consisting of the second frame body 44 to which the cone paper is attached and the first frame body 15 to which the damper is attached. The two frame bodies can be easily coupled together, that is, can be integrated into one piece with one operation of fitting. Parts are put in each of the frame bodies 15, 44. Thus, the two-piece structure consisting of the first assembly 11 and the second assembly 12, where both of the assemblies have respective parts already put together and can be readily coupled together, can be easily achieved.

The two-piece structure of the frame 14 enables the parallel production of each assembly and the production efficiency can be easily improved compared to the conventional production method where parts are put in a frame one by one.

In addition, the two-piece structure of the frame 14 enables an easy and diversified coupling of the first assembly 11 of various types with the damper 17 of different shape or dimension to the second assembly 12 of various types with the cone paper 45 of different shape or dimension. The standardization of parts and the improvement in flexibility resulted from the diversified combination of the first and second assemblies selected can enhance the productivity.

Further, the tinsel wires 40 connected to the voice coil 35 and the pins 24, 24 of the terminal 25 can be wired for connection with the second assembly 12 not attached. Thus, the voice coil 35 and the terminal 25 can be easily wired.

Furthermore, since the frame 14 has the two-piece structure, the diameter of the damper 17 and the diameter of the cone paper 45 can be arbitrarily set. For example, as in the second embodiment of the present invention shown in FIG. 3 to FIG. 5, the diameter of the damper 17 can be easily set larger than the diameter of the cone paper 45, which increases the compliance, allowing the minimum resonance frequency to be lower than conventionally, whereby lower sound can be reproduced without deterioration in workability.

Figure 3:
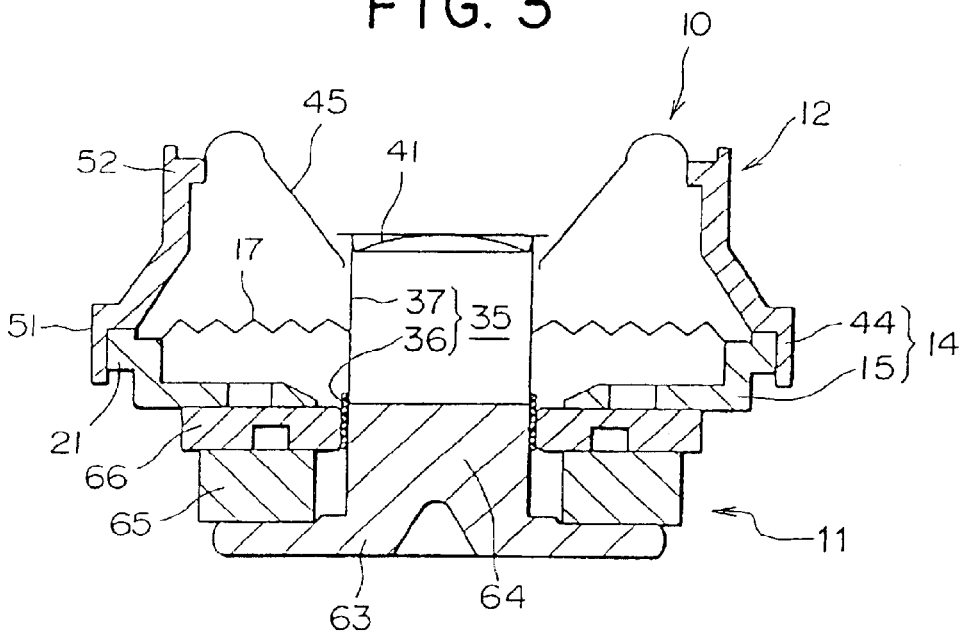
FIG. 3 is a cross-section view showing another embodiment of a speaker of the present invention.
Figure 4:
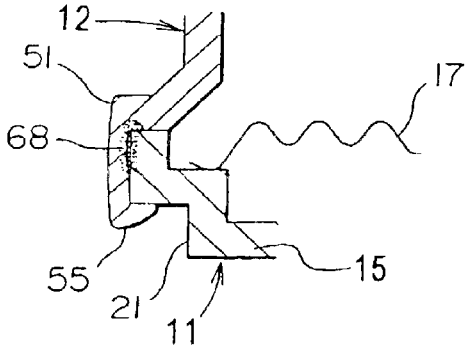
FIG. 4 is a magnified cross-section view of a part of the speaker shown in FIG. 3.
Figure 5:
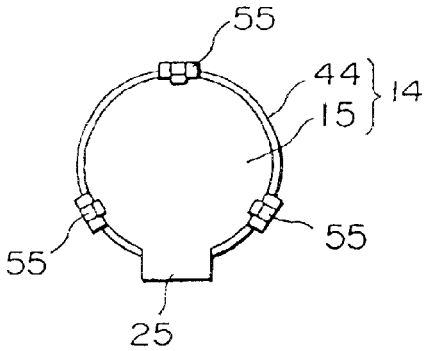
FIG. 5 is a bottom view of the speaker shown in FIG. 3.
Figure 6:
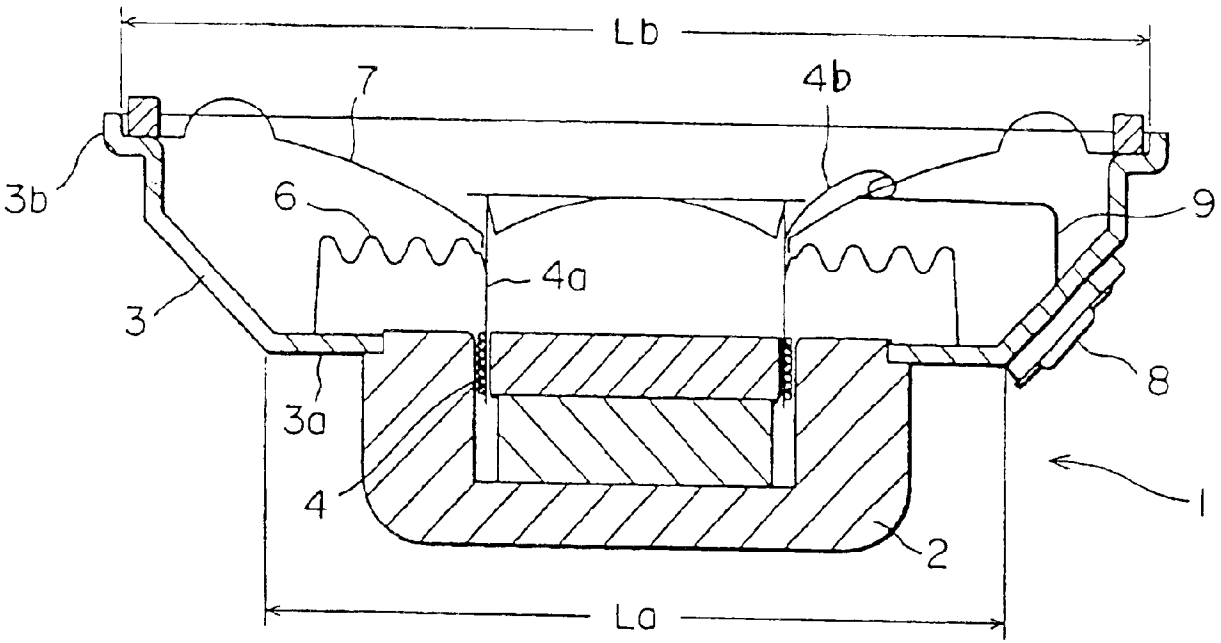
FIG. 6 PRIOR ART
FIG. 6 is a cross-section view showing a conventional speaker.

For example, as in the second embodiment shown in FIG. 3 to FIG. 5, in the speaker 10 constructed by joining the first assembly 11 including the first frame body 15 and the second assembly 12 including the second frame body 44, the diameter of the bottom part 51 of the second frame body can be set larger than the diameter of the head part 52 of the second frame body, and the diameter of the damper 17 can be set larger than the diameter of the cone paper 45.

In addition, in the second embodiment, the engaging part 21 of the first frame body 15 is formed with a step extending outward as shown in FIG. 4. The magnetic circuit 16 comprises a center pole 64 having a disk-shaped bottom plate 63 at its bottom, a doughnut-shaped magnet 65 set around the center pole 64, and a top plate 66.

In each embodiment described above, the first frame body 15 and the second frame body 44, which constitute the frame 14, are formed of synthetic resin such as ABS resin, vinyl chloride resin, polyethylene resin. However, one or both of the frame bodies may also be formed of other materials like metal such as die-cast of aluminum, zinc or so.

In each embodiment described above, an engaging part with a flange shape is set at the first frame body 15 and three claw-shaped hook parts are set at the second frame body 44, thereby enabling the two frame bodies to engage with each other. The structure is not limited to this, as long as the two frame bodies can be coupled together with a snap by engagement. For example, the engaging part of the first frame body 15 may be claw-shaped and the hook part of the second frame body 44 may be made into a flange-shaped step.

The number of the claws is not limited to three, and may be one, two, four or more. The claw may be ring-shaped to be entirely deformable for engagement. The connection part between the first frame body 15 and the second frame body 44 may be further fixed with resin adhesive 68 as shown in FIG. 4 or by welding, in addition to engaging means.

In the speaker and its production method of the present invention, since the frame is divided into the first frame body and the second frame body, the first assembly having the voice coil, the magnetic circuit and the damper attached to the first frame body, and the second assembly having the diaphragm attached to the second frame body can be produced separately. The speaker can be produced by putting together the first assembly and the second assembly. This enables the parallel production of each part, the standardization of the parts for various types of speakers and the wiring between the voice coil and the terminal without the interference of the second assembly, thereby improving productivity compared to the structure where parts are put one by one in an integrally formed frame.

In this process, the first frame body and the second frame body can be engagedly attached to each other by hooking easily. This leads to the improvement in the productivity.

Also, the magnetic circuit of the first assembly can be set after the first assembly and the second assembly have been put together.

What is claimed is:

1. A speaker comprising:

a frame including a first frame body a second frame body;

a voice coil, an outer magnet type magnetic circuit and a damper attached to said first frame body; and an outer circumferential portion of a diaphragm attached to said second frame body, wherein the voice coil, the outer magnet type magnetic circuit, the damper and the outer circumferential portion of the diaphragm are attached to said first frame body and said second frame body respectively before the integration of said first frame body and said second frame body by engaging a first engagement portion on said first frame body with a second engagement portion on said second frame body, a diameter of a second frame bottom part side is larger than a diameter of a second frame head part side, and a diameter of said damper body is larger than a diameter of the diaphragm.

2. A speaker comprising:

a frame including a first frame body and a second frame body;

a voice coil, an outer magnet type magnetic circuit and a damper attached to said first frame body; and an outer circumferential portion of a diaphragm attached to said second frame body, wherein the voice coil, the outer magnet type magnetic circuit, the damper and the outer circumferential portion of the diaphragm are attached to said first frame body or said second frame body respectively before the integration of said first frame body and said second frame body by engaging a first engagement portion on said first frame body with a second engagement portion on said second frame body; and a diameter of said damper attached to said first frame body is larger than a diameter of said diaphragm attached to said second frame body.

3. A speaker as described in claim 2, wherein said magnetic circuit is an outer magnet type comprising a bottom plate having a center pole, a ring-shaped magnet fixed on said bottom plate, and a top plate fixed on said magnet.

4. A speaker as described in claim 2, wherein said first engagement portion of said first frame body is formed integrally with a head-side edge of said first frame body, and said first engagement portion protruding from said first frame body in an outwardly radial direction in a shape of a flange.

5. A speaker as described in claim 2, wherein said second frame body includes:

a second frame body bottom part having said second engagement portion to engage with the first engagement portion on said first frame body, and a second frame body head part attached to said outer circumferential portion of said diaphragm.

6. A speaker as described in claim 2, wherein a diameter of said second frame bottom part is larger than a diameter of a second frame head part side, and a diameter of said damper attached to said first frame body is larger than a diameter of said diaphragm.

* * * * *